United States Patent [19]

Porter

[11] 4,289,015

[45] Sep. 15, 1981

[54] CHAIN LINK TOOL

[75] Inventor: Thomas M. Porter, Concord, Mass.

[73] Assignee: H. K. Porter, Inc., Somerville, Mass.

[21] Appl. No.: 125,972

[22] Filed: Feb. 29, 1980

[51] Int. Cl.[3] ..... B21D 37/12

[52] U.S. Cl. ..... 72/384; 59/7; 72/409; 81/306; 81/311

[58] Field of Search ..... 72/384, 409; 59/7, 11, 59/3; 81/303, 304, 305, 306, 307, 308, 309, 310, 311, 312; 152/213 R, 213 A

[56] References Cited

U.S. PATENT DOCUMENTS

| | | | |
|---|---|---|---|
| D. 150,222 | 7/1948 | Gile | 72/409 |
| 807,240 | 12/1905 | Carstensen | 81/5.1 R |
| 1,338,804 | 5/1920 | Woodworth | 72/409 |
| 1,399,665 | 12/1921 | Shapiro | 72/409 |
| 1,494,399 | 5/1924 | Woodworth | 72/392 |
| 1,510,953 | 10/1924 | Murphy | 81/323 |
| 1,698,474 | 1/1929 | Friedl | 72/384 |
| 2,192,487 | 3/1940 | Porter | 72/384 |

FOREIGN PATENT DOCUMENTS

| | | | |
|---|---|---|---|
| 481550 | 3/1952 | Canada | 59/7 |

*Primary Examiner*—Gene P. Crosby
*Attorney, Agent, or Firm*—Russell & Nields

[57] ABSTRACT

A chain link tool including a pair of jaws on one side of the tool adapted to close the respective eyes of a cross chain connecting link, said jaws moving together as the handles are moved together and conversely, and such that a groove and a projection on the other side of the tool are adapted to receive the transverse portion of the side chain and to grasp the curved end of the cross-chain connecting link respectively when the handles are apart and to disengage the cross-chain connecting link as the handles are moved together.

3 Claims, 7 Drawing Figures

CHAIN LINK TOOL

BACKGROUND

1. Field of Invention

The present invention relates generally to chain link tools suitable for operating upon cross chain connecting links of anti-skid tire chains and the like, and more particularly to tools of this type including means for closing the eye portions of generally U-shaped cross chain connecting links about substantially transversely disposed portions of side chains, and means for removing cross chain connecting links so attached to side chains.

2. Summary of Prior Art

In chain link assemblies such as anti-skid tire chains, the cross chains, which extend at a substantially perpendicular angle to the side chains, are ordinarily connected to the side chains by means of generally U-shaped cross chain connecting links. At each such connection an end link of a cross chain engages the bight of a cross chain connecting link whose arms are bent over into eyes encircling a portion of the side chain. The assembly of such a connection has accordingly been found to be a relatively simple process including the steps of engaging the last link of a cross chain with the bight of a cross chain connecting link, engaging the arms of the cross chain connecting link, which at the outset extend in the form of open hooks, about a substantially transversely disposed portion of the side chain, and bending the ends of the hooks down to close the throats of the hooks sufficiently to retain the side chain, thereby forming the open hooks into closed eyes. A standard pair of pliers will suffice for the performance of the eye formation operation, however, it has been found by numerous workers in the art that contouring the opposing jaw faces to the shape of the wire of the link against which they are to bear and providing gripping or biting means to such contoured jaws facilitates the eye formation operation and reduces bothersome slippage of the tool.

The disassembly of a cross chain to side chain connection has been found to be more difficult. To disassemble the connection the closed eyes of the cross chain connecting link must be opened, however, as there is no readily available means of leverage suitable for a standard prying tool, the disassembly of such connections has been found to be both time consuming and difficult. To solve this problem numerous chain link tools have been developed incorporating counteracting jaws of one sort or another for closing the eyes of a cross chain link and means for opening the eyes. Among the means for opening the eyes so suggested are wedge-like elements adapted to be forced into the eyes as shown in U.S. Pat. Nos. 1,510,953 and 2,192,487; a tool adapted to grasp the bight of the cross chain connecting link and the closed ends of the arms and to pull the bight downward while the ends of the arms are pushed upward and outward as in U.S. Pat. Nos. 1,338,804 and 1,494,399; and a pair of pliers wherein the jaws move away from each other as the handles are closed thereby allowing the convenient exertion of spreading forces against the inside of the eye as shown in U.S. Pat. No. Des. 150,222.

In many situations it is important that a broken or damaged cross shain be easily and quickly removable. Thus, in the driving context for example, a broken or damaged cross chain may be excessively noisy and may also cause damage to the vehicle if it is not removed, yet road conditions may preclude removal of the entire anti-skid chain. In such a situation it is additionally important that the individual removing the cross chain not unduly expose himself to oncoming traffic or to the elements. The above-referred-to prior devices which emphasize operating on the cross chain connecting link alone are unsatisfactory in this regard in that operating on an in place anti-skid chain is at best awkward and time consuming and at worst impossible.

SUMMARY OF THE PRESENT INVENTION

The basic purpose of any chain link tool is to provide a device useful in the attachment and removal of cross chain connecting links to or from substantially transversely disposed portions of side chains. The closing and opening of the eyes of the cross chain connecting link are inherently necessary to the accomplishment of these purposes, and accordingly, each of the known tools described above is particularly adapted to perform the opening and closing operations on these eyes directly. I have found, however, that while the closing operation must be performed on the eyes themselves, the link removal operation may be more easily, efficiently, and quickly performed by a tool which forces the cross chain connecting link out of engagement with the side chain in a single operation. To accomplish this in the context of a useful chain link tool the present invention contemplates a hand operable plierlike tool including a first lever and a second lever, each lever including a proximal handle portion and a distal head portion, wherein the distal head portion of the first lever member comprises first and second corresponding flat elements disposed in spaced stacked relation, each element having a substantially straight outer edge, an inner edge curved away from the outer edge of the element as it rises from the handle portion, a forward edge, first and second projections arising from the section of the forward edge adjacent the inner edge defining a slightly upwardly slanted groove therebetween and a third, downwardly hooked, projection extending outwardly of the section of the outer edge adjacent the forward edge; the distal head portion of the second lever member comprises a single flat element having a substantially straight outer edge, an inner edge curved away from the outer edge of the single element, a forward edge, a fourth projection arising from the forward edge of the single element adjacent its inner edge, and a fifth, downwardly hooked projection extending outwardly of the outer edge of the single element adjacent its forward end; and wherein the single element of the second lever member is pivotally mounted adjacent the base of the fifth projection to the areas adjacent the bases of the third projections of the first and second elements of the first lever in the space therebetween such that the third and fourth projections form a pair of jaws on one side of the tool adapted to close the respective eyes of a cross-chain connecting link, said jaws moving apart as the handles are moved apart and conversely, and such that the groove and the fifth projection on the other side of the tool are adapted to receive the transverse portion of the side chain and to grasp the curved end of the cross-chain connecting link respectively when the handles are apart and to disengage the cross-chain connecting link as the handles are moved together.

It is accordingly an object of the present invention to provide a chain link tool incorporating new and improved means for removing a cross chain connecting link in a single quick and simple operation along with counteracting jaw-like means for attaching a cross chain connecting link to a side chain.

It is also an object of the present invention to provide a new and improved chain link tool which may be manufactured as a lightweight yet strong device suitable for single handled operation and convenient retention in a standard tool kit or glove compartment.

BRIEF DESCRIPTION OF THE DRAWINGS

These, as well as other features, objects, and advantages of the present invention, will be more clearly understood by reference to the following detailed description of a preferred embodiment of the present invention and to the drawings in which.

DETAILED DESCRIPTION OF PREFERRED EMBODIMENT

Figure 3:
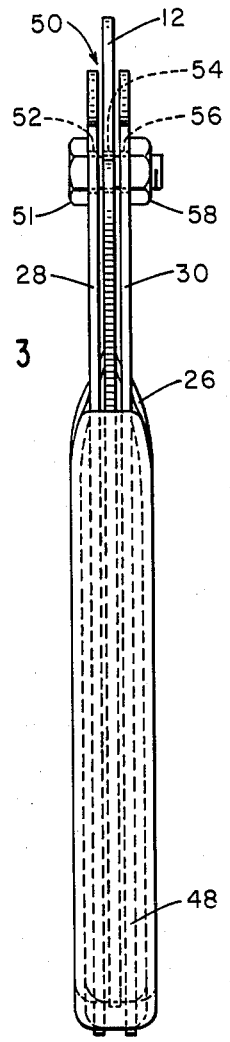
FIG. 3 is a right side elevation of the chain link tool of FIG. 1.

Referring now specifically to the drawings, wherein like reference numerals are used to designate like elements throughout, a chain link tool in accordance with the present invention is shown in the closed (FIG. 1) and open (FIG. 2) positions and from the side (FIG. 3). FIGS. 4–7 show a typical cross chain connecting link upon which the present tool is adapted to operate from various angles in both its original (open eyes) and attached (closed eyes) configuration. The tool, generally indicated at 2, comprises two lever members pivoted together in a plier-like configuration as will more fully hereinafter appear. For convenience these lever members will hereinafter be referred to as the left lever member 4 and the right lever member 6, it being understood that the designations "left" and "right" are arbitrary and with reference to the drawings, and that the designations would be reversed if the tool were to be viewed from the side opposite to that shown in FIGS. 1 and 2.

The chain link tool of the present invention is, in a manner analogous to a standard pair of pliers, so constructed that the left lever member 4 and the right lever member 6 are pivotally attached to each other at a point 8 located on the vertical axis 10 of the tool. Left lever member 4 includes a single, substantially flat element 12 having a narrow proximal end 14, a forward end 16 sloped at an acute angle downward and to the right from axis 10, an outer edge 18 extending in an approximately straight line from proximal end 14 to forward end 16, an inner edge 20 which curves away from outer edge 18 as it extends from proximal end 14 to forward end 16, an upwardly hooked projection 22 extending outwardly of forward end 16 adjacent inner edge 20, a downwardly hooked projection 24 extending outwardly of outer edge 18 adjacent forward end 16; and a grip 26 of generally U-shaped cross section affixed by welding or other convenient means to the outer edge 18 of element 12 so as to form a contoured smooth surface which may be comfortably grasped by a user.

Lever member 6, on the other hand, comprises a pair of corresponding elements, 28 and 30 respectively, disposed in spaced, stacked relation, as best seen in FIG. 3. Elements 28 and 30 each have a narrow proximal end 32, a forward end 34 sloped at an acute angle downward and to the left of axis 10, an outer edge 36 which extends in an approximately straight line from the proximal end 32 to the forward end 34, an inner edge 38 which curves away from outer edge 36 as it extends from proximal end 32 to forward end 34, a pair of projections 40 and 42 extending outwardly from forward end 34 adjacent inner edge 38 defining a slightly upwardly sloping groove 44 therebetween, and a downwardly hooked projection 46 extending outwardly of outer edge 36 adjacent forward end 34. A grip 48, similar to grip 26, is affixed to the outer edges 36 of elements 28 and 30 adjacent the proximal ends 32 thereof.

Left lever member 4 is pivotally attached to right lever member 6 in the space 50 between elements 28 and 30 such that grips 26 and 48 are located on the outside edges of the assembled tool by means of a threaded bolt 51 passed through a hole 52 drilled through element 28 at the base of projection 46 and thence through a hole 54 drilled through element 12 at the base of projection 24 and finally through a hole 56, corresponding to hole 52 in element 28, drilled through element 30. Bolt 51 is secured in place by a threaded nut 58 engaging the threads of bolt 51. Permissibly, a stop 60 may be disposed in the space 50 between elements 28 and 30 extending outwardly of the inner edges 38 thereof opposite the upper portion 62 of grip 48. This stop will simply limit the travel of element 12 in the space 50 between elements 28 and 30 as the grips 26 and 48 are brought together during operation of the tool thereby preventing jamming of the tool and inadvertent injury to a user occassioned by the catching of the flesh of a hand between the closing levers.

It has been found that a chain link tool of the above described construction wherein elements 12, 28, and 30 and grips 26 and 48 are formed from 1/16" sheet steel stock provides a tool with adequate strength and rigidity for operation on standard tire chains yet which is of light enough weight for convenient storage and use. Lever members 4 and 6 and their associated grips, 26 and 48 respectively, may of course, be formed as unitary structures rather than separate elements if desired without departure from the present invention.

Figure 1:
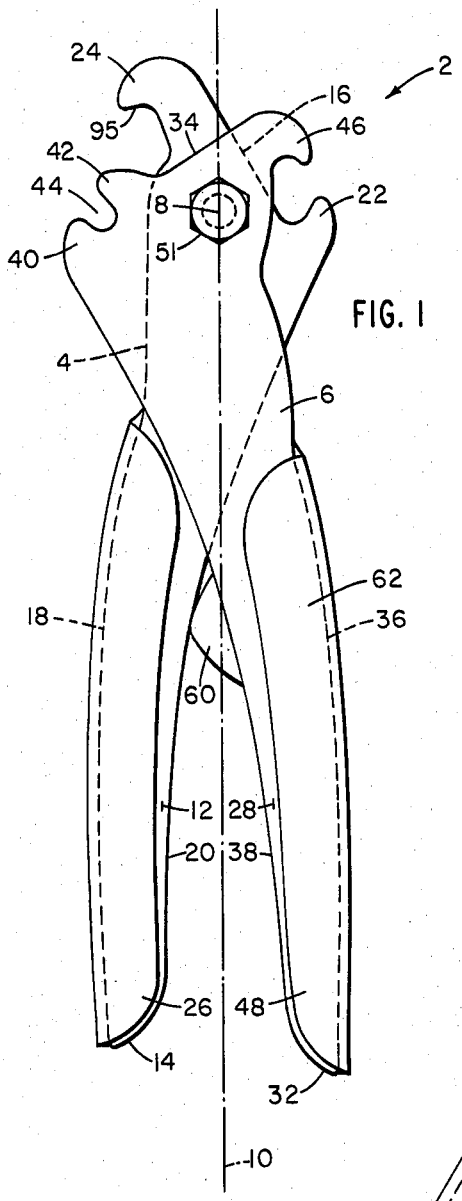
FIG. 1 is a front elevation of a chain link tool in accordance with the present invention wherein the tool is shown in the closed position.
Figure 2:
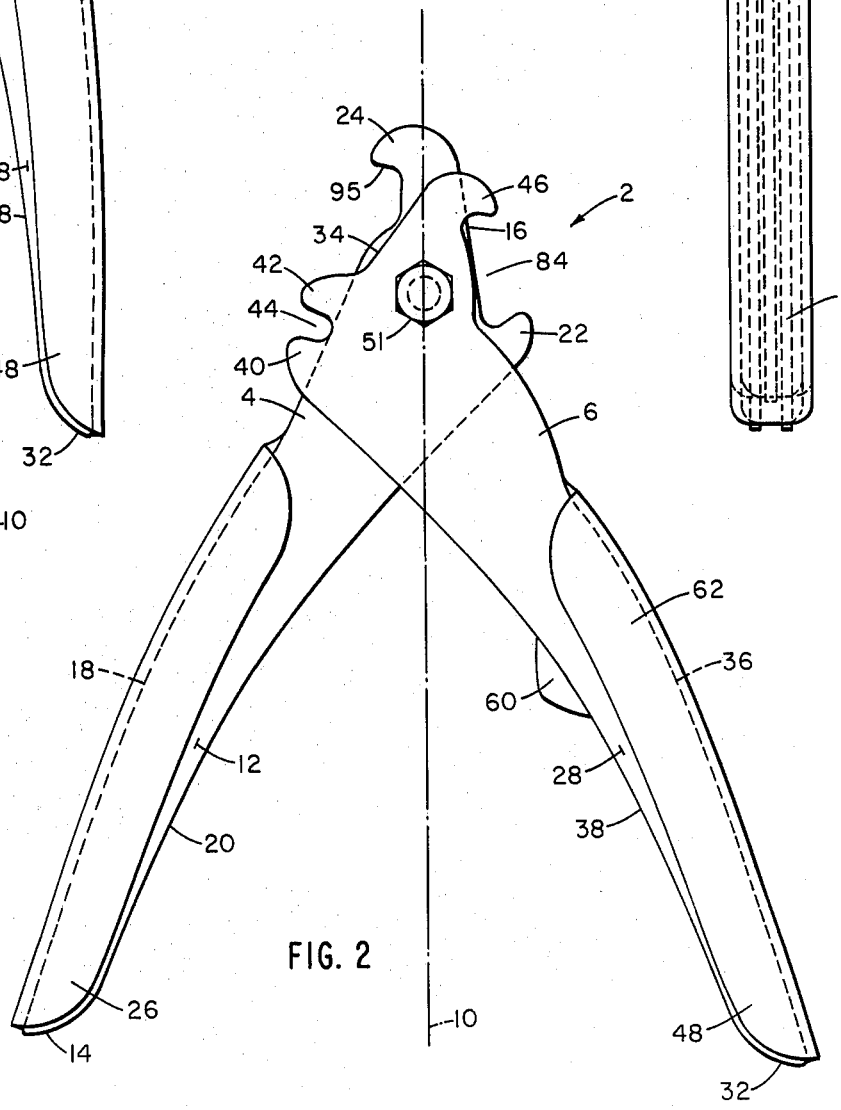
FIG. 2 is a front elevation of the chain link tool of FIG. 1 wherein the tool is shown in the open position.
Figure 4:
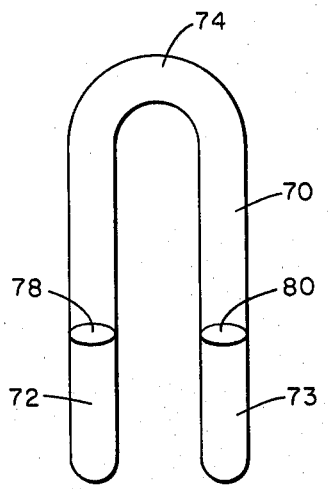
FIG. 4 is a front elevation of a typical cross chain connecting link in the open configuration.
Figure 5:
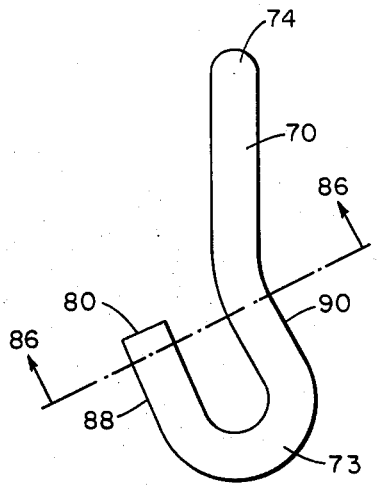
FIG. 5 is a right side elevation of the cross chain connecting link of FIG. 4.
Figure 6:
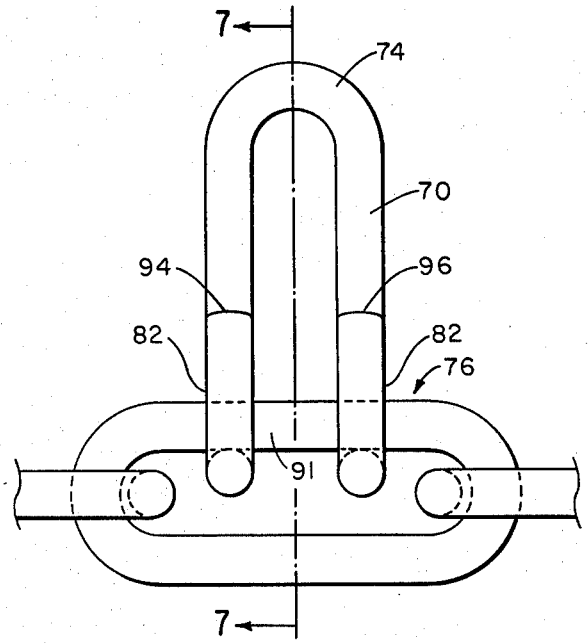
FIG. 6 is a front elevation a typical cross chain connecting link attached to a transverse portion of a link of a side chain.
Figure 7:
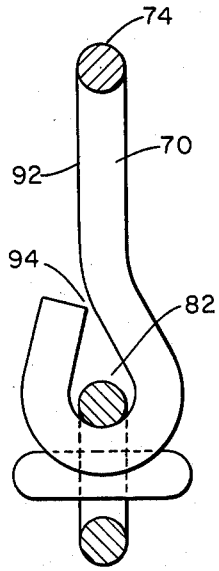
FIG. 7 is a cross sectional view taken along the line 7—7 of FIG. 6.

The operation of this tool will be best understood with reference to FIGS. 4–7 in conjunction with FIGS. 1 and 2. The connections between the cross chains and the side chains of chain link assemblies such as anti-skid tire chains are usually formed by cross chain connecting links 70, such as that shown in FIGS. 4 and 5, which are of a general U-shaped in front elevation (FIG. 4) and which have their ends bent over to form open hooks 72 and 73. To assemble the connection, the terminal link of the cross chain proper is hooked to the connecting link 70 so as to encircle the body of the U in the area 74. The open hooks 72 and 73 are then hooked around a substantially transversely disposed portion 76 of the side chain and the ends 78 and 80 of hooks 72 and 73 are bent down closing the open throats of hooks 72 and 73 thereby forming closed eyes 82 about portion 76. This bending operation is performed by the present tool by placing the connecting link 70 in the space 84 (FIG. 2) such that line 86-86 lies substantially in the plane of the tool and projection 22 engages portion 88 of connecting line 70, and projections 46 engage portion 90 of connecting line 70, or conversely. Then by simply squeezing grips 26 and 48 together, i.e., closing the tool from its open position FIG. 2 to its closed position FIG. 1, the open hooks 72 and 73 may be individually formed into eyes 82.

To remove a connecting link attached as above, the part 91 of portion 76 of the side chain which is disposed between the eyes 82 is placed in groove 44 and area 74 of connecting link 70 is placed under hooked portion 95 of projection 24, with the tool in the open FIG. 2 position, such that the ends 78 and 80 are on the side 92 of connecting link 70 which is not adjacent the tool. Then by simply squeezing grips 26 and 48 together as above described portion 76 of the side chain will be forced through openings 94 and 96 disengaging the connection. It should be noted in this regard that the presence of elements 28 and 30 on either side of element 12 in this configuration allows portion 76 to be forced through openings 94 and 96 at substantially the same time. If this were not the case portion 76 would tend to twist and disengage from one eye but not the other. Additionally, the fact that portion 76 is disengaged from both eyes 82 at approximately the same time means not only that removal of a cross chain may be quickly and conveniently accomplished but also that the ends 78 and 80 of the connecting link 70 are bent outwardly approximately the same amount and only enough to allow portion 76 to pass. This can be significant, especially for older connecting links and for links which have been repeatedly attached and removed, in minimizing both metal fatigue and breakage of the hooked portions 72 and 73.

It should be understood that the embodiments and practices described and portrayed herein have been presented by way of disclosure, rather than limitation, and that various modifications, substitutions and combinations may be effected without departure from the spirit and scope of this invention in its broader aspects. Thus, for example, while the present invention has been described in the context of a single hand operable device for use on anti-shid tire chains, the tool could obviously be made of heavier steel and with elongated handles for greater leverage and strength or even two handed or machine aided operation upon connecting links of substantially any size chain.

I therefor claim:

1. A chain link tool for closing the eye portions of a generally U-shaped cross-chain connecting link about a substantially transversely disposed portion of a side chain and for removing cross-chain links which are so attached comprising a first lever member and a second lever member, each said lever member including a proximal handle portion and a distal head portion; the distal head portion of the first lever member comprising first and second corresponding flat elements disposed in spaced stacked relation, each said element having a substantially straight outer edge, an inner edge curved away from the outer edge of said element as it rises from the handle portion, a forward edge, first and second projections arising from the section of the forward edge adjacent the inner edge defining a slightly upwardly slanted groove therebetween and a third, downwardly hooked, projection extending outwardly of the section of the outer edge adjacent the forward edge; the distal head portion of the second lever member comprising a single flat element having a substantially straight outer edge, an inner edge curved away from the outer edge of said single element, a forward edge, a fourth projection arising from the forward edge of the single element adjacent its inner edge, and a fifth, downwardly hooked projection extending outwardly of the outer edge of the single element adjacent its forward end; said single element of said second lever member being pivotally mounted adjacent the base of the fifth projection to the areas adjacent the bases of the third projection of the first and second elements of the first lever in the space therebetween such that the third and fourth projections form a pair of jaws on one side of the tool adapted to close the respective eyes of the cross-chain link said jaws moving apart as the handles are moved apart and conversely, and such that said groove and said fifth projection on the other side of the tool are adapted to receive the transverse portion of the side chain and grasp the curved end of the cross-chain link respectively when the handles are apart and to disengage the cross-chain connecting link as the handles are moved together.

2. The chain link tool of claim 1 wherein the outer edge of the distal head portion of the first lever member adjacent the third projection is inwardly contoured to expand the size of the opening for the eye of a cross-chain link which may be closed therewith.

3. The chain link tool of claim 1 wherein means are disposed along the inner edge of one of said handles to limit the extent to which they may be moved toward each other.

* * * * *